US005315353A

United States Patent [19]

Simazaki et al.

[11] Patent Number: 5,315,353

[45] Date of Patent: May 24, 1994

[54] IMAGE RECORDING METHOD INCLUDING DETERMINING A GAP BETWEEN A PHOTOSENSITIVE MEDIUM AND A DEVELOPING ROLLER AND APPARATUS THEREFOR

[75] Inventors: Yuzuru Simazaki; Takao Kumasaka; Kunio Satoh, all of Hitachi; Youji Hirose, Mito, all of Japan

[73] Assignees: Hitachi, Ltd.; Hitachi Koki Co., Ltd., both of Tokyo, Japan

[21] Appl. No.: 951,122

[22] Filed: Sep. 25, 1992

Related U.S. Application Data

[63] Continuation-in-part of Ser. No. 545,576, Jun. 29, 1990.

[30] Foreign Application Priority Data

Sep. 26, 1991 [JP] Japan ..... 3-247321

[51] Int. Cl.[5] ..... G03G 15/09

[52] U.S. Cl. ..... 355/251; 355/245; 355/326 R

[58] Field of Search ..... 355/245, 251, 246, 261, 355/265, 326, 327; 430/30, 31, 35, 39, 105, 108, 122; 118/647, 653, 656, 657, 651

[56] References Cited

U.S. PATENT DOCUMENTS

| | | | |
|---|---|---|---|
| 4,194,466 | 3/1980 | Haberhauer | 118/657 |
| 4,434,221 | 2/1984 | Oka | 430/122 |
| 4,466,732 | 8/1984 | Folkins | 118/657 X |
| 4,797,335 | 1/1989 | Hiratsuka et al. | 430/122 X |
| 5,025,288 | 6/1991 | Kusuda | 355/251 |
| 5,168,027 | 12/1992 | Taguchi et al. | 430/108 |
| 5,187,523 | 2/1993 | Osawa | 355/251 |

*Primary Examiner*—A. T. Grimley
*Assistant Examiner*—Sandra L. Brasé
*Attorney, Agent, or Firm*—Antonelli, Terry, Stout & Kraus

[57] ABSTRACT

An image recording apparatus including a photosensitive medium. A voltage is applied between the photosensitive medium and a developing sleeve of a developing unit, and a current flowing between the photosensitive medium and the developing sleeve is measured to be converted into a pulse waveform which is then compared by a predetermined reference value. On the basis of the result of the comparison, a gap is determined between the photosensitive medium and the developing unit, which is then advanced or retracted toward or from the photosensitive medium in accordance with the determined gap. Owing to the recording method carried out by the image recording apparatus, the gap can be selectively determined by observing the current waveform pattern of the current flowing between the photosensitive medium and the developing sleeve while decreasing gradually the gap therebetween, whereby a relation between the gap and height of a magnetic brush can definitely be established. Since the gap can be set within a range from a value representing an initial contact state in which the magnetic brush starts to contact with the photosensitive medium to a value representing a wholly contact state in which the whole magnetic brush contacts with the photosensitive medium with the aid of a current curve of the current flowing between the photosensitive medium and the developing sleeve, a contacting force of the magnetic brush bearing on the photosensitive medium can be weakened.

18 Claims, 5 Drawing Sheets

IMAGE RECORDING METHOD INCLUDING DETERMINING A GAP BETWEEN A PHOTOSENSITIVE MEDIUM AND A DEVELOPING ROLLER AND APPARATUS THEREFOR

CROSS-REFERENCE TO RELATED APPLICATION

The present application is a continuation-in part of copending U.S. application Ser. No. 07/545,576 filed on Jun. 29, 1990 entitled "Developing Method and Apparatus utilizing Magnetic Brush" by Yuzuru SIMAZAKI el al. and assigned to the present assignees, the contents of which is incorporated herein by reference.

BACKGROUND OF THE INVENTION

The present invention relates to an image recording method and an image recording apparatus in which a clearance or gap between a photosensitive medium and a developing roller of a developing unit can selectively be determined in a convenient manner.

There are proposed a variety of color image recording methods and color image recording apparatuses which are based on the electrophotographic principle. Among them, such type of color image recording apparatus in which a color image is formed on a surface of a photosensitive medium constituted by a rotating drum, belt or the like and transferred to a recording paper or sheet is excellent over the others in view of high speed operation and continuous paper or sheet recording specifications.

In the recording apparatus in which a color image is once formed on a surface of a photosensitive medium and then transferred to a recording sheet and in which a photosensitive medium of a drum-like structure is employed, a plurality of electrostatic latent image forming units and developing units for developing the latent images in different colors, respectively, are disposed along the rotating direction of the drum-like photosensitive medium in opposition to the outer peripheral surface thereof, wherein a toner image of a first color is formed on an image forming region of the photosensitive drum, which is then followed by formation of a toner image in a second color. In this way, the image developing process is repeated a number of times.

Thus, in the case of the recording apparatus of the type described above, the development of a color toner of a second latent image is performed on the surface of the drum-like photosensitive medium on which the toner image of the first color has been formed. Consequently, when the developer (i.e. developer or agent) is brought into contact completely with the surface of the photosensitive medium, the toner image of the first color will possibly be scraped off by the developing device upon forming the second color image, as a result of which image density of the first color is deteriorated, presenting thus a problem that the color mixing is brought about upon image development of the second color because of mixing of the toner of the first color with that of the second color. Same problem may similarly arise in association with the developing devices or units for the third and other subsequent colors.

As approaches proposed heretofore for solving the above problem, there may be mentioned techniques disclosed in Japanese Examined Publication No. JP-B-63-43748 and Japanese Unexamined Publication No. JP-A-56-144452. According to the technique described in the first mentioned publication, it is taught in conjunction with the contact of a magnetic brush formed on a developing roller of a developing unit with the photosensitive medium that a sliding contact force of the magnetic brush of a second developing unit which is exerted to the photosensitive medium surface is selected smaller than that of the magnetic brush of the first developing unit, so that upon development of the image in a second color, the toner image of the first color is protected from being scraped off by the magnetic brush of the second developing unit.

On the other hand, in the case of the recording apparatus described in the second mentioned publication, a developer or toner of the second developing unit is held contactless relative to the photosensitive medium, wherein an agitator device is provided for imparting agitation to the developer for thereby allowing the developer to form a magnetic brush on an outer peripheral surface of a developing roll for developing a toner image on the drum-like photosensitive medium.

In either of the recording apparatuses disclosed in both publications mentioned above, a clearance or gap is provided between any one of the developing rollers and the photosensitive medium, wherein the magnetic brushes are formed on an outer peripheral surfaces of the developing rollers, respectively. However, in order to realize a color image of satisfactory quality, there arises necessity for determining definitely a relation between the gap and a height of the magnetic brush. Additionally, it is required to secure the density of the toner image of a first color as well as that of the second color toner image. In other words, an attempt to secure the toner image density of the first color is usually accompanied with lowering and/or nonuniformity in the toner image density of the second color. On the other hand, attempt for securing the toner image density of the second color tends to result in appearance of a fog which lowers the toner image density of the first color. Besides, consideration will have to be paid to the degree of contact between the developing roller and the magnetic brush in the developing area as well as the image quality.

SUMMARY OF THE INVENTION

It is an object of the present invention to provide an image recording method and an image recording apparatus which are capable of realizing a multi-color image transfer while assuring a stable and enhanced image quality by determining definitely the contacting state between a photosensitive medium and a magnetic brush and by selecting a gap or clearance between the photosensitive medium and a developing roller of a developing unit in accordance with the contacting state as determined.

In view of the above and other objects which will become apparent as description proceeds, there is provided according to a first aspect of the invention, in an image recording method, a magnetic brush of a two-component developer is formed on each of developing rollers provided in a plurality of developing units, respectively, a toner image of a first color is formed on a recording area of photosensitive medium by a first one of the plural developing units and then a toner image of another color is formed on the recording area of the photosensitive medium by a succeeding one of the developing units through contact of the magnetic brush with the photosensitive medium during a single rotation of the photosensitive medium, wherein a predetermined voltage is applied between the photosensitive medium and the developing roller of at least one of the plural developing units, a current flowing between the photosensitive medium and the developing roller upon application of the predetermined voltage is measured, and wherein the current flowing between the photosensitive medium and the developing roller is so determined as to fall within a range from a value representing an initial contact state in which only a tip end portion of the magnetic brush is brought into contact with the photosensitive medium to a value representing a wholly contact state in which the magnetic brush contacts substantially wholly with the photosensitive medium, by changing a degree of the contact of the magnetic brush with the photosensitive medium, and then a gap between the photosensitive medium and the developing roller is so selected that the current lies within the range mentioned above.

As a preferred mode for carrying out the image recording method of the invention, it is taught that a waveform pattern of the current flowing between the photosensitive medium and the developing roller is established on the basis of a predetermined degree of contact of the magnetic brush with the photosensitive medium, a predetermined voltage is applied between the photosensitive medium and the developing roller of at least one of the plural developing units, a current flowing between the photosensitive medium and the developing roller upon application of the voltage is measured and then a gap between the photosensitive medium and the developing roller is selected on the basis of magnitude of the current measured and the current waveform pattern representing the degree of contact of the magnetic brush with the photosensitive medium while changing the degree of the contact.

In another preferred mode for carrying out the image recording method according to the present invention, it is proposed that a waveform pattern of a current flowing between the photosensitive medium and the developing roller is established on the basis of a predetermined degree of contact of the magnetic brush with the photosensitive medium, the developing roller of the developing unit is moved away from the photosensitive medium to such an extent that the magnetic brush does not contact with the photosensitive medium, a predetermined voltage is then applied between the photosensitive medium and the developing roller of at least one of the plural developing medium, and the gap between the photosensitive medium and the developing roller in the state where the voltage is applied is progressively decreased while observing magnitude of the current flowing between the photosensitive medium and the developing roller as well as the current waveform pattern which changes as the gap decreases, and then the gap between the photosensitive medium and the developing roller is so selected that a current waveform pattern as observed coincides at least approximately with the predetermined current waveform pattern.

In yet another mode for carrying out the image recording method according to the invention, it is taught according to the invention that a metallic drum having an electric resistance of substantially zero is mounted in place of the photosensitive medium, a waveform pattern of a current flowing between the metallic drum and the developing roller is established on the basis of a degree of contact of the magnetic brush with the metallic drum, a predetermined voltage is applied between the metallic drum and the developing roller of at least one of the plural developing units, a current flowing between the metallic drum and the developing roller upon application of the voltage is measured, the gap between the metallic drum and the developing roller is determined on the basis of magnitude of the current flowing between the metallic drum and the developing roller as well as the current waveform pattern representing the degree of contact of the magnetic brush with the metallic drum, and then the metallic drum is replaced by a semiconductive photosensitive medium after having set the gap.

There is provided according to another aspect of the invention an image recording apparatus, wherein a magnetic brush of a two-component developer is formed on each of developing rollers provided in a plurality of developing units, respectively, a toner image of a first color is formed on a recording area of a photosensitive medium by a first one of the plural developing units and then a toner image of following colors is formed on the recording area of the photosensitive medium by a succeeding one of the developing units through contact of the respective magnetic brushes with the photosensitive medium during a single rotation of the photosensitive medium, which apparatus comprises the photosensitive medium having a recording area on an outer surface thereof in which a toner image is formed in the course of rotation of the photosensitive medium, a power supply source for applying a predetermined voltage between the photosensitive medium and the developing roller of at least one of the plural developing units, an monitoring unit for measuring a current flowing between the photosensitive medium and the developing roller, converting the measured current into a pulse waveform and comparing the pulse waveform with a predetermined reference pulse waveform, a selecting unit for selectively determining a gap between the photosensitive medium and the developing roller of the aforementioned at least one developing unit on the basis of the result of the comparison available from the output of the observing unit, and a moving unit for advancing or retracting the aforementioned at least one developing unit toward or from the photosensitive medium on the basis of the gap determined by the selecting unit.

In a preferred embodiment of the invention, the moving unit includes an eccentricity absorbing unit for accommodating or absorbing (or compensating for) possible eccentricity of the photosensitive medium which may take place during the rotation thereof, wherein the eccentricity absorbing unit is composed of a guide rail, a rail moving on and along the guide rail while supporting the developing unit, a motor for driving the rail, and a database storing data concerning the positional deviations of the photosensitive medium for commanding the motor to revolve the photosensitive medium so as to cancel out eccentricity thereof.

In another preferred embodiment of the invention the monitoring unit may include a resistance decreasing unit for decreasing electric resistance of an insulation layer forming the outer surface of the photosensitive medium, and a resistance adjusting unit for lowering the electric resistance of the two-component developer contained within the developing unit to within a standard range when the electric resistance of the developed is higher than a reference electric resistance value thereof. The resistance adjusting unit may include a container containing electrically conductive magnetic particles, a measuring unit for measuring the electric resistance of the two-component developer accommodated within the developing unit, and a supply unit for admixing the electrically conductive magnetic particles to the developer accommodated within the developing unit from the container to thereby lower the electric resistance of the developer to within a standard resistance range when the electric resistance of the two-component developer is detected to be higher than the reference resistance value thereof. In a further preferred embodiment of the invention, the monitoring unit may include at least a current-to-voltage converter for converting the current flowing between the photosensitive medium and the developing roller, a reference voltage generator for generating a reference voltage serving as a reference for the voltage generated by the current-to-voltage converter, a voltage comparator for comparing the voltage with the reference voltage, and a counter for counting pulses outputted from the comparator.

In yet another embodiment of the invention, the selecting may unit include a first comparator which is operated when the number of the pulses outputted from the counter is smaller than a reference value, an advancing power supply source for commanding the moving unit to move the developing roller toward the photosensitive medium in response to the operation of the first comparator, a second comparator which operates when the number of pulses outputted from the counter is greater than a predetermined value, and a retracting power supply source for commanding the moving unit to retract the developing roller from the photosensitive medium in response to the operation of the second comparator.

As will be apparent from the above description, it is possible according to the teachings of the present invention to establish optimally the relation between the height of the magnetic brush and the gap defined between the photosensitive medium and the developing roller of the developing unit nevertheless of extremely delicate nature of the gap by virtue of such arrangement that the current waveform pattern is previously established and the gap between the photosensitive medium and the developing roller of the developing unit is selected on the basis of magnitude of the current flowing between the photosensitive medium and the developing roller upon application of a voltage between the photosensitive medium and the developing roller as well as the current waveform pattern.

Furthermore, owing to such arrangement that the current flowing between the photosensitive medium and the developing roller of the developing unit is measured upon application of a voltage therebetween and that the current flowing between the photosensitive medium and the developing roll is so set as to fall within a range of a value representing an initial state in which a tip end of the magnetic brush contacts with the photosensitive medium to a value representing a wholly contact state in which substantially whole magnetic brush contacts with the photosensitive medium by changing correspondingly the degree of contact of the developing roller with the photosensitive medium, whereon the gap between the photosensitive medium and the developing roller is so selected that the current flowing therebetween falls within the above-mentioned range, it is possible to weaken positively the contacting force of the magnetic brush formed on the developing roller exerted onto the photosensitive medium. Thus, there can be suppressed positively such possibility that a static latent image of a first color developed on the photosensitive medium by the first developing unit may be scraped off by the magnetic brush upon development by the successive developing unit even though a toner image is developed on the photosensitve medium by the successive developing unit, whereby not only the toner image of the first color can be maintained but also the density of the toner image of following colors can optimally be ensured. In this manner, the toner images of the first and the following colors can be stabilized in respect to the image quality thereof.

Besides, by moving progressively the developing roller relative to the photosensitive medium in the state in which a voltage is applied between the photosensitive medium and the developing roller and monitoring the current waveform pattern which varies as the developing roller is moved by means of the observing unit, it is possible to establish definitely or optimally the relation between the height of the magnetic brush and the gap between the photosensitive medium and the developing roller.

DESCRIPTION OF THE PREFERRED EMBODIMENTS

Now, the present invention will be described in detail in conjunction with exemplary or preferred embodiments thereof by reference to the accompanying drawings.

Figure 6:
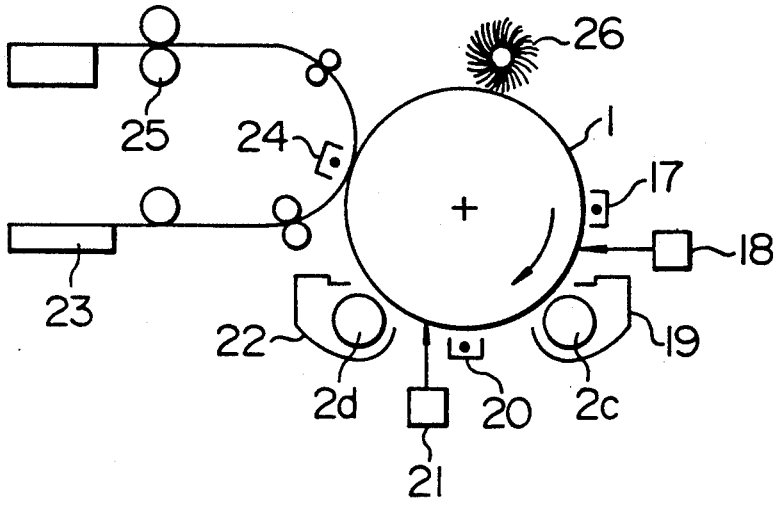
FIG. 6 is a schematic view showing a structure of a color electrophotographic apparatus to which the image recording method according to the present invention is applied.

For having better understanding of the invention, description will first be made of a color electrophotographic apparatus used in general as an image recording apparatus. The color electrophotographic apparatus is so designed as to be capable of printing an image in different colors, e.g. in black and other colors, and includes a first image forming subsystem and a second image forming subsystem disposed around a drum-like photosensitive medium (hereinafter also referred to as the photosensitive drum) 1, as is shown in FIG. 6. The first image forming subsystem is composed of a first electric charger 17, a first illuminating device 18 and a first developing unit 19 which are disposed in this order along the rotating direction of the photosensitive drum 1. In the course of rotation of the drum-like photosensitive medium or the photosensitive drum 1, the first image forming subsystem electrically charges uniformly the outer peripheral surface of the photosensitive drum 1 by means of the first electric charger 17, which is then followed by exposure of the drum surface to illumination such as of a laser beam modulated with image or video information and projected by the illuminating device 18 to thereby produce an electrostatic latent image on the photosensitive drum surface. When the electrostatic latent image area passes by the first developing unit 19 as the photosensitive drum 1 rotates, a toner image of a first color is generated on the photosensitive drum surface, having been developed by a first color toner of the first developing unit 19.

The second image forming subsystem is composed of a second electric charger 20, a second illuminating device 21 and a second developing unit 22 disposed in this order around the photosensitive drum 1 in succession to the first image forming subsystem as viewed in the rotating direction of the photosensitive drum 1. During rotation of the photosensitive drum 1, the second image forming subsystem operates in the following manner. Namely, after formation of the toner image of the first color on the photosensitive drum 1 by the first developing unit 19, the photosensitive drum 1 is electrically charged by the second charger 20, and then exposed to illumination by the second illuminator 21, whereupon a toner image of a second color is formed on the photosensitive drum 1 by the second developing unit 22. In this manner, there are formed in the recording area of the photosensitive drum 1 the toner image of the first color developed by the first image forming subsystem and the toner image of the second color developed by the second image forming subsystem.

As the rotation of the photosensitive drum 1 progresses further, the toner image of the first and second colors is electrostatically transferred from the photosensitive drum 1 by a transfer unit 24 to a recording sheet or paper supplied from a sheet hopper 23 and then thermally fixed by a fixing unit 25. Upon completion of the image transfer from the photosensitive drum 1, the toner remaining on the drum is removed by means of a toner cleaner 26.

In the image developing process described above, the developing roller 2cof the first developing unit 19 belonging to the first image forming subsystem is brought into contact with the photosensitive drum 1, while the developing roller 2dof the second developing unit 22 belonging to the second image forming subsystem 22 is caused to contact only slightly with the photosensitive drum 1.

Figure 1:
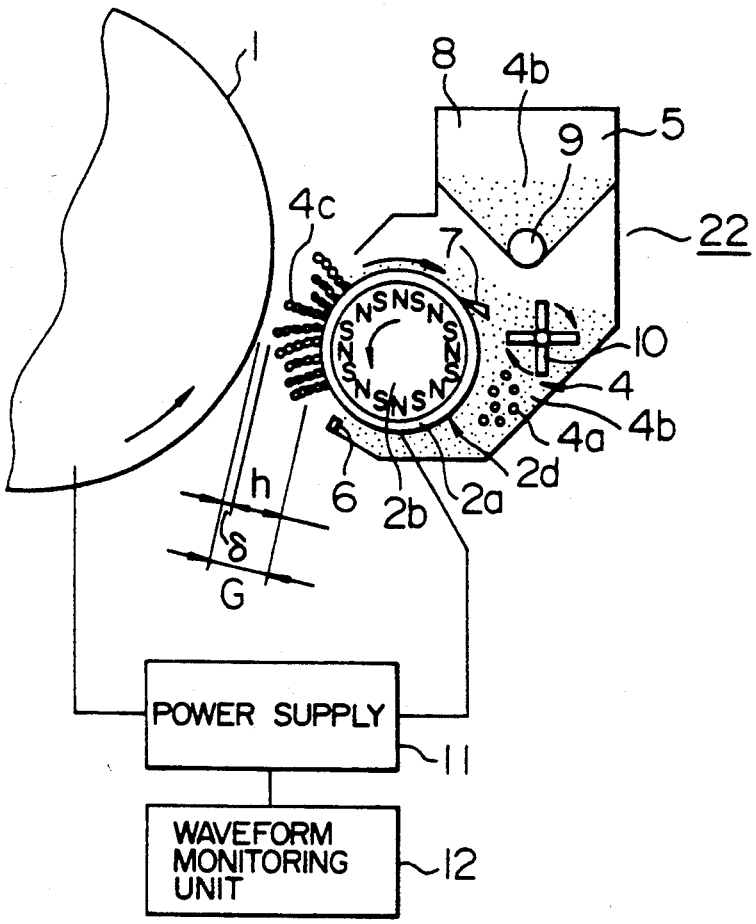
FIG. 1 is a schematic view showing an exemplary embodiment of an image recording apparatus for carrying out an image recording method according to the present invention.

In the second developing unit 22, there is disposed a developing roller 2 in opposition to the photosensitive drum 1, wherein a developer 4 is fed to the developing roller 2, as shown in FIG. 1.

The developing roller 2 is composed of a sleeve 2a made of a non-magnetic electrically conductive material in a cylindrical form and disposed in opposition and in parallel to the photosensitive drum 1 with an extremely small gap between the drum 1 and the sleeve 2a and a magnet roller 2b disposed inside of the sleeve 2a, wherein upon image developing operation, the sleeve 2a and the magnetic roller 2b are rotated in the opposite directions, respectively, by means of a driving source not shown. In that case, the sleeve 2a is rotated in the direction opposite to that of the photo-sensitive drum 1. The developer 4 is composed of a resin carrier 4a prepared by admixing pulverized magnetic material to a pulverized resin and toner particles 4b mixed with the resin carrier 4a. The developer 4 is accommodated within a developing container 5. The developer 4 is attracted onto the outer peripheral surface of the sleeve 2a under the action of a magnetic force of the magnet roller 2b upon rotations of the sleeve 2a and the magnet roller 2b in the opposite directions, as a result of which a magnetic brush 4c is formed, as shown in FIG. 1, whereby a latent image on the rotating photosensitive drum 1 is developed by the magnetic brush 4c into a toner image of the second color. Thus, it is necessary to set or adjust a relation between the gap G defined between the developing sleeve 2d and the photosensitive drum 1 on one hand and the height h of the magnetic brush on the other hand so that the size of the gap G falls within a predetermined range.

The developer container 5 which accommodates therein the developer 4 is equipped with a toner hopper 8 disposed at the top end of the container 5 for accommodating the toner 4b. Mounted rotatably in the top hopper 8 at a bottom portion thereof is a replenishing roller 9 which is adapted to be driven rotationally when the amount of toner 4b within the developer container 5 decreases below a predetermined level to resupply the toner 4b from the toner hopper 8 to the developer container 5. Further, mounted rotatably within the developer container 5 is an agitator 10 which is constituted by a propeller-type wheel (or blade wheel) and which serves to agitate the developer 4 within the developer container 5 as well as the toner 4b replenished from the toner hopper 8 and transports the developer 4 and the toner 4b toward the developing sleeve 2a under agitation. Additionally, there are provided within the developer container 5, a regulating plate 6 and a scraper 7. The former serves to regulate the developer adhering to the surface of the developing sleeve 2a to a predetermined amount, while the scraper 7 is used for scraping off the developer 4 from the surface of the developing sleeve 2a.

The present invention starts from a discovery that the characteristic of a current flowing through the gap when a voltage is applied between the photosensitive drum 1 and the developing roller 2d of the second developing unit 22 changes in dependence on the degree of contact of the magnetic brushes 4c to the photosensitive drum 1. By taking advantage of this fact, the present invention teaches to selectively determine a proper value of the gap G between the photosensitive drum 1 and the developing roller 2d on the basis of result of observation of the above-mentioned current characteristic. In the following description of the image recording apparatus, it is assumed that the selection of the gap G is performed in conjunction with the second developing unit 22. It is however obvious that such gap selection technique may equally be applied to determination or setting of the gap defined between the developing roller 2c and the photosensitive drum 1 of the first developing unit 19 shown in FIG. 6. Further, it should be appreciated that the selective gap setting taught by the invention is applicable to any other developing units which can be provided in a number corresponding to that of colors in which an image is to be printed. Furthermore, not only the first and second developing units 19 and 22, but also number of the developing units corresponding to number of the colors can be applicable for adjusting the gap between the developing roller and the photosensitive drum.

The principle underlying the present invention will be elucidated. Let's assume that a voltage is applied across the photosensitive drum 1 an the developing sleeve 2*a*. In that case, when the gap G between the photosensitive drum 1 and the developing sleeve 2*a* is changed, the degree of contact of the magnetic brush 4*c* formed on the developing sleeve 2*a* relative to the photosensitive drum changes, incurring a corresponding change in the current characteristic. Typical examples of such changes in the current characteristic are graphically illustrated in FIG. 2. As can be seen in the figure, when the gap G is of such a great magnitude that the magnetic brush 4*c* on the developing sleeve 2*a* does not contact with the photosensitive drum 1, the current Id assumes a minimum level. Thus, in this state, substantially no current can flow. By decreasing progressively the gap G starting from this state, the current Id starts to increase from the lowest level. More specifically, an inflection point P shown in FIG. 2 indicates a position where the tip or free end of the magnetic brush 4*c* begins to contact with the surface of the photosensitive drum 1 and where the magnetic brush 4*c* is of a maximum height.

Figure 2:
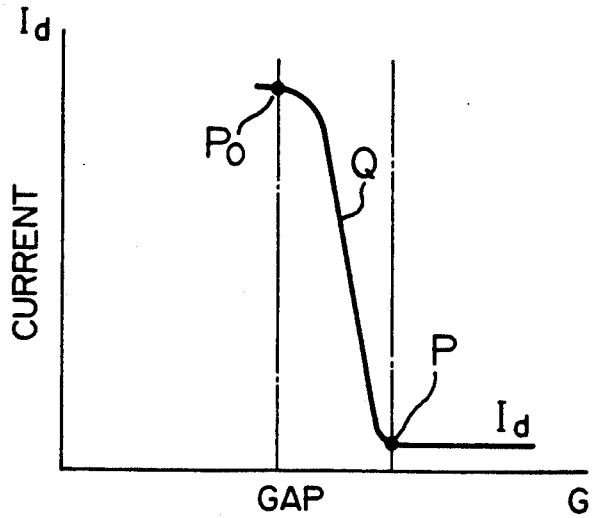
FIG. 2 is a view showing a current-versus-gap characteristic curve indicating a relation between an electric current flowing between a photosensitive medium and a developing roller and a ga established therebetween.

When the developing sleeve 2*a* becomes closer to the photosensitive drum 1 starting from the abovementioned position with the gap G being narrowed progressively, the gap current Id increases rapidly, as can be seen in FIG. 2. However, when the gap G has been narrowed down to a predetermined value, the current Id tends to become saturated. At a saturated state represented by $P_0$, the whole magnetic brush 4*c* is brought to contact with the outer surface of the photosensitive drum. In this way, flow of the current Id between the photosensitive drum 1 and the developing sleeve 2*a* is caused to change as a function of change in the gap G.

Figure 3:
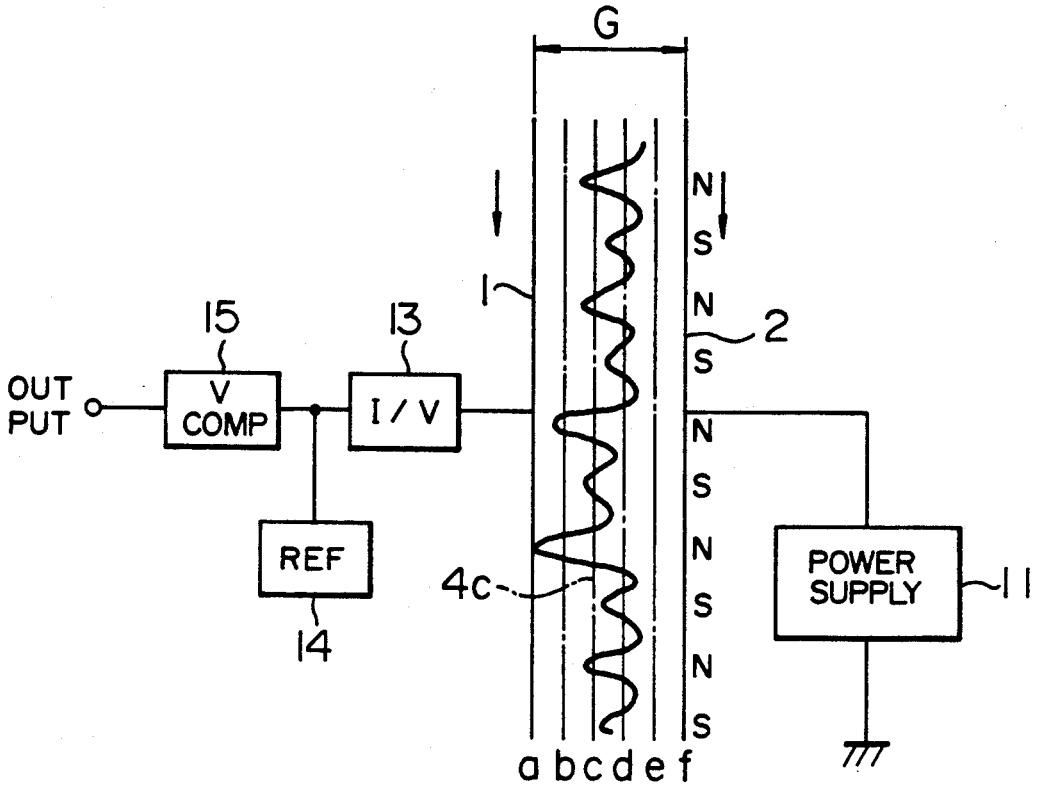
FIG. 3 is a block diagram showing a general arrangement of a current waveform monitoring unit.
Figure 4A:
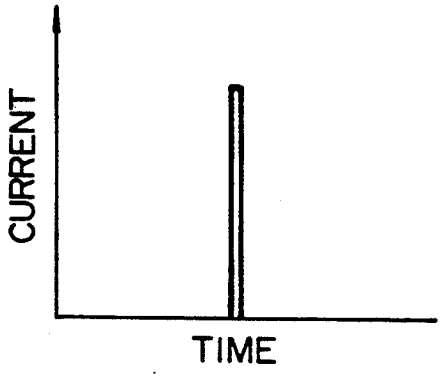
FIGS. 4A, 4B, 4C, 4D and 4E are views showing graphically current waveform patterns corresponding to changes in the degree of contact of a magnetic brush with a photosensitive medium.
Figure 4B:
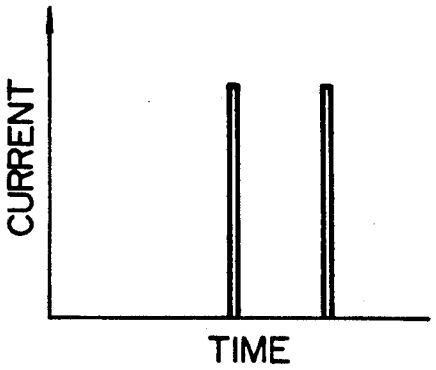
Figure 4C:
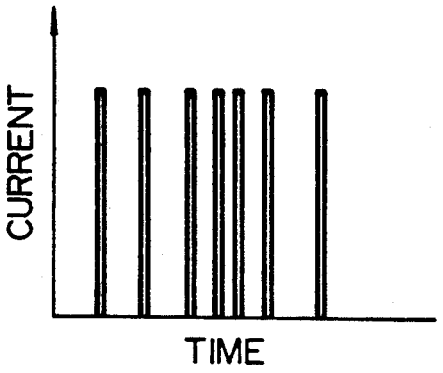
Figure 4D:
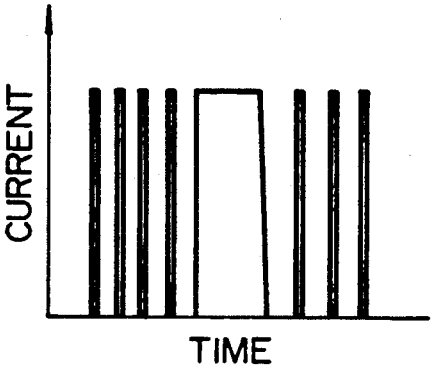
Figure 4E:
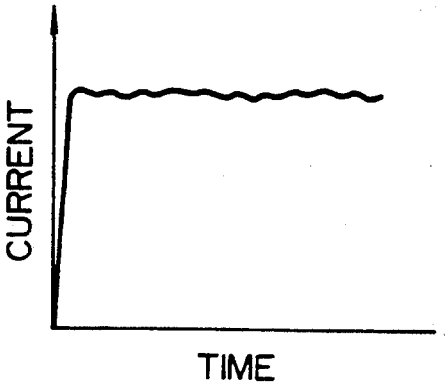

According to the invention, such change in the gap current Id brought about by changing the gap G is observed. In that case, since the current may change rather delicately, it is preferred to convert the change of the current Id to current pulses for the observation. By way of example, when the gap G between the photosensitive drum 1 and the developing sleeve 2*a* lies within a range from a to f shown in FIG. 3, contact between the tip end of the magnetic brush 4*c* and the photosensitive drum surface 1 at a single point gives rise to generation of, a one-pulse current, as shown in FIG. 4A. On the other hand, in the state where the gap G lies within a range from b to f shown in FIG. 3, contact between the magnetic brush 4*c* and the photosensitive drum 1 at two discrete points gives rise to generation of two current pulses, as illustrated in FIG. 4B. Further, when the magnetic brush 4*c* contacts with the photosensitive drum surface at a plurality of discrete points or locations with the gap G being in a range of c to f, a number of current pulses corresponding to the number of contacting points are generated, as shown in FIG. 4C. Additionally, when the gap G is in the range of d to f shown in FIG. 3, a pulse current of a waveform shown in FIG. 4C is generated. Finally, when the gap G assumes a value in a range from e to f, such a pulse current as shown in FIG. 4E is produced. In the case of the current of the waveform shown in FIG. 4E, the magnetic brush 4*c* as a whole is in contact with the photosensitive drum surface 1, as a result of which a pulse-like current flows in continuation without intermission.

As will now be appreciated from the foregoing, the gap G can optimally be selected by measuring the current Id flowing between the photosensitive drum 1 and the developing sleeve 2*a* and by observing the waveform pattern of the current Id.

Thus, it is contemplated with the present invention to set previously the pattern of the current Id as shown in FIG. 4B or FIG. 4C and decrease the gap G progressively from the time point at which a voltage is applied between the photosensitive drum 1 and the developing sleeve 2*a* until the pattern of the current Id flowing in this state becomes coincident at least approximately with the preset pattern, whereupon the gap G is set at a value corresponding to the preset pattern for which coincidence is detected.

To implement the concept of the invention, there is provided a power supply source 11 for applying a voltage across the photosensitive drum 1 and the developing sleeve 2*a* and measuring the applied voltage in combination with a current waveform conversion/monitor unit 12 for converting the waveform of the current Id flowing between the photosensitive drum 1 and the developing sleeve 2*a* to the pulse-like current waveforms such as illustrated in FIGS. 4A to 4E and observing the current waveform pattern. The current waveform conversion/monitor unit 12 is composed of a current/voltage converter 13, a reference voltage generator 14 and a voltage comparator 15 interconnected in a manner shown in FIG. 3, wherein a current flowing through the gap G upon application of a voltage across the gap G is converted into a measurement voltage by the current/voltage converter 13. The output voltage of the converter 13 is compared with a reference voltage generated by the reference voltage generator 14. On the basis of the result of the comparison, a corresponding pulse-like current is outputted. In this way, by applying a voltage between the photosensitive drum 1 and the developing sleeve 2*a* and observing waveform pattern of the current Id with the aid of the current waveform monitor unit 12, it is possible to set the gap G at a value where coincidence with the pattern shown in FIG. 4B or 4C can be monitored.

In this conjunction, it is noted that when a high voltage on the order of 3000 V/mm or higher in terms of field strength is applied between the photosensitive drum 1 and the developing sleeve 2*a*, an extremely large current flow may take place abruptly although it depends on the degree of contact of the magnetic brush 4*c* with the photosensitive drum 1, incurring eventually local electric discharge between the photosensitive drum 1 and the developing sleeve 2*a*. As a result of this, not only the measurement with the current waveform monitor unit 12 is rendered impossible but also the latter may be injured. In order to avoid this problem, it is preferred to apply a voltage in a range of 1 to 250 V across the gap G so that the field strength becomes lower than 3000 V/mm at which no electric discharge can occur. Besides, a semiconductive developer should preferably be employed with the proportion of the pulverized magnetic material relative to the resin carrier being selected higher than 70%.

In this manner, by setting previously the current waveform pattern of the current Id, by applying a voltage between the photosensitive drum 1 and the developing sleeve 2*a* of the second developing unit 22, by monitoring the current waveform pattern Id flowing through the gap under the voltage as applied while decreasing progressively the gap G, and by fixing or selecting the gap G at the value where the current waveform pattern as observed coincides substantially with the reference current pattern, it is possible to establish a definite relation between the gap G and the height h of the magnetic brush 4c even though the gap G is of very delicate nature.

Figure 5:
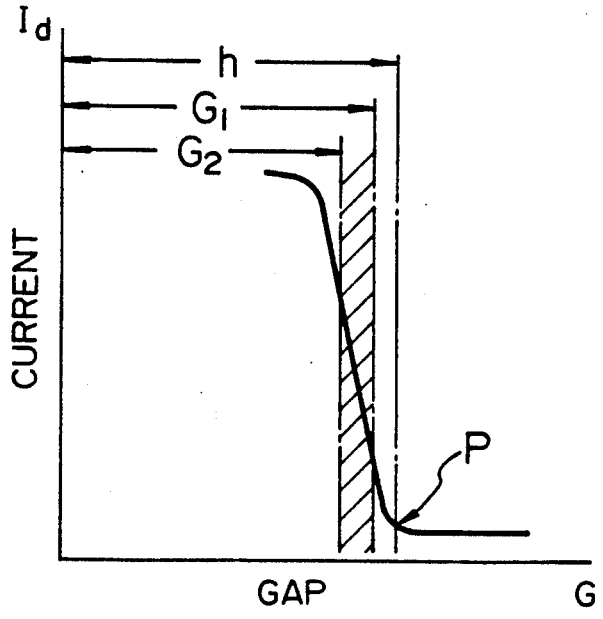
FIG. 5 is a view for illustrating determination of a preferable gap to be set between the photosensitive medium and the developing roller for a given gap current pattern.

Since the preset reference pattern is such as shown in FIG. 4B or FIG. 4C and because the gap G is so set that the current flowing between the photosensitive drum 1 and the developing sleeve 2a exceeds the inflection point P on the current curve Q shown in FIG. 2 while lying within a range smaller than the saturation level, it is possible to weaken positively the degree of contact (or contacting force) of the magnetic brush 4c formed on the developing sleeve 2a relative to the photosensitive drum 1. At this juncture, the range which lies above the inflection point P and below the saturation level $P_0$ corresponds to a range lying between the values G1 and G2 of the gap G as indicated by a hatched area in FIG. 5. Thus, even in the case where an area on the photosensitive drum surface 1 which has undergone development by the first developing unit 17 is developed by the second developing unit 22, there arises no possibility of the magnetic brush 4c scraping off the toner image of the first color formed on the semiconductor drum surface 1 by the first developing unit 17. For this reason, not only the toner image of a first color can positively be maintained but also the toner image density of a second color can properly be secured. In this way, upon formation of a toner image of two colors, both the toner images of first and second colors, respectively, can properly be formed.

It should further be mentioned that since the voltage applied between the photosensitive drum 1 and the developing sleeve 2a is on the order of 1 to 250 V, there arises no fear of occurrence of electric discharge or the like unwanted phenomenon between the photosensitive drum 1 and the developing sleeve 2a. Besides, because a resin carrier 4a is used as the carrier to be mixed with the toner 4b for preparing the developer, a crest portion of the magnetic brush 4c formed by the resin carrier 4a becomes more flexible or soft when compared with the case where a two-component developer containing a ferrite carrier, whereby the scraping action exerted to the toner image of the first color formed on the photosensitive drum surface can be weakened to thereby prevent positively the toner image of the first color from being scraped off by the magnetic brush in the second color image developing process. Additionally, because the devèloper 4 is imparted with a conductivity of a semiconductor range by selecting the proportion of the magnetic toner to the resin carrier 4a so as to be higher than 70%, unwanted possibility of occurrence of the electric discharge can further be suppressed. In the case of the instant embodiment of the invention, the photosensitive drum 1 which is to be intrinsically incorporated in the recording apparatus is used for setting the gap G. However, the gap G can also be set optimally by using a metallic drum made of an electrically conductive material having a resistance value approximating zero such as exemplified by a metallic drum made of aluminum or the like. After having determined the optimal gap G between the metallic drum and the developing sleeve 2a by applying a voltage in the manner described above, the metallic drum may then be replaced by the conventional drum-like photosensitive medium.

When the metallic drum such as made of aluminum is used for setting in advance the gap G, regulation of the voltage by the power supply source 11 as well as identification of the pulse current by the current waveform observation unit 12 can be performed with an increased accuracy because the electric resistance of the metallic drum is approximately zero, whereby the gap G can be set or established more precisely and optimally when compared with determination of the gap based solely on the use of the photosensitive drum 1 having a resistance in a semiconductor range. Further, the methods of setting previously the gap G by using a metallic drum can be applied not only to two-color or multi-color image printer type recording apparatuses but also to a monochromatic image printer type recording apparatus.

As will be apparent from the description made so far, the image recording apparatuses for carrying out the image recording method according to the present invention includes the power supply source 11 for applying a desired voltage between the photosensitive drum 1 and the developing sleeve 2a and the current waveform monitor unit for monitoring the pulse waveforms resulting from conversion of the current flowing through the gap G, wherein the relation between the gap G and the height of the magnetic brush 4c can definitely be determined by moving progressively the developing sleeve 2a to the photosensitive drum 1 while monitoring the current waveform pattern which varies in accompanying the displacement of the developing sleeve 2a with the aid of the current waveform monitoring unit 12, as a result of which the setting of the gap G can be achieved with high accuracy and high reliability.

Figure 7:
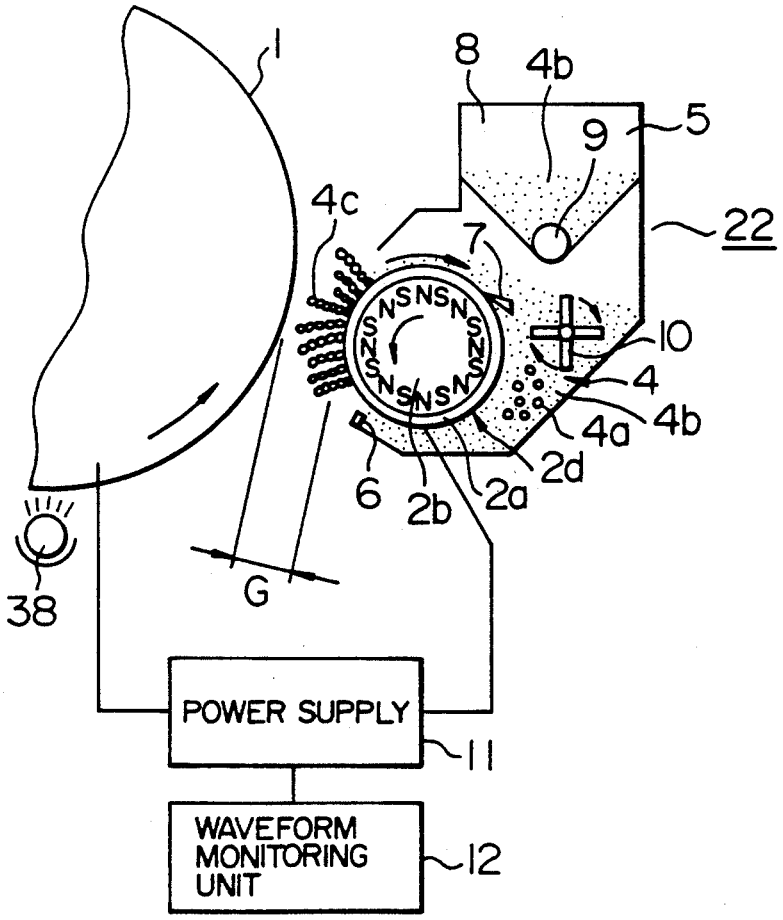
FIG. 7 is a schematic view showing an image recording apparatus according to another embodiment of the invention.

FIG. 7 shows a second embodiment of the image recording apparatus according to a second embodiment of the invention, which is arranged such that the photosensitive drum 1 is exposed to illumination of the illuminating unit 38 to thereby lower the electric resistance of an insulation layer constituting the outer peripheral surface of the photosensitive drum 1 before performing development by the second developing unit 22. In this case, the illuminating unit 38 may be constituted by the second illuminating unit 21 shown in FIG. 6 or alternatively by another unit provided only for the purpose of illumination mentioned above.

By lowering in advance the electric resistance of the insulating layer forming the surface of the drum-like photosensitive medium 1 by exposing it to the illumination of the first illuminating unit 38, it is possible to measure with an improved sensitivity the current flowing upon application of a voltage between the photosensitive drum 1 and the developing sleeve 2a with the aid of the power supply source 11. This in turn means that observation of the pulse-like current by the current waveform monitor unit 12 can performed more accurately, whereby setting of the gap G between the photosensitive drum 1 and the developing sleeve 2a can be easily be realized more conveniently and optimally. In this conjunction, the exposure of the photosensitive drum to the illumination of the illuminating unit 38 for the purpose of lowering the electric resistance as mentioned above should preferably be performed when the recording apparatus is at rest or in a warming-up phase for securing the quality of the drum-like photosensitive medium. At this juncture, it should also be mentioned that the since exposure of the photosensitive medium to the illumination is only for a short time, there is practically no possibility of the photosensitive medium 1 being optically fatigued.

Figure 8:
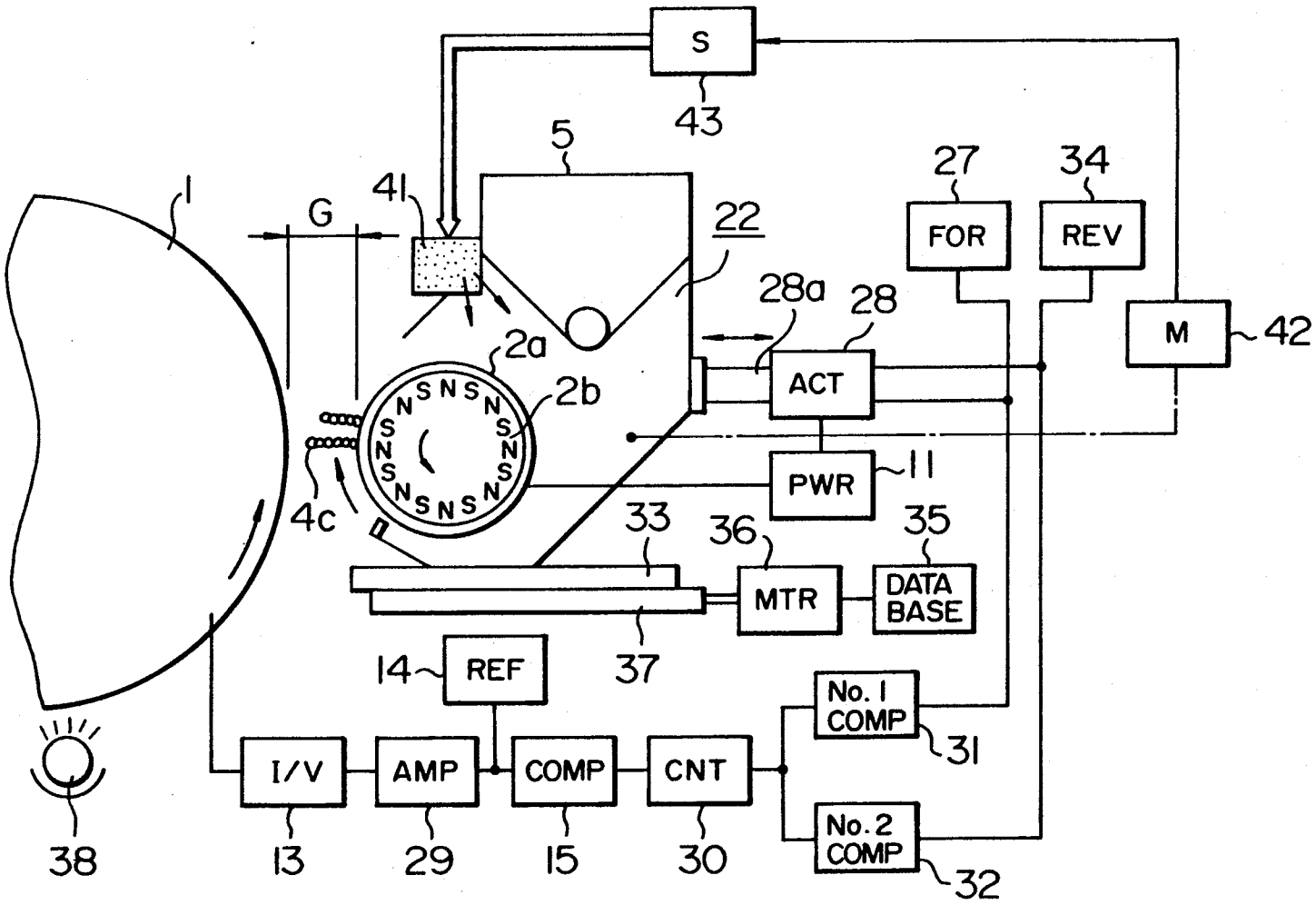
FIG. 8 is a view showing schematically a structure of a color electrophotographic system which incorporates an image recording apparatus according to the invention.

FIG. 8 shows an exemplary embodiment of the color electrophotographic system which incorporates an image recording apparatus according to the invention.

This color electrophotographic system is designed such that two-color printing can be realized during a single complete rotation of a photosensitive drum 1 by developing a latent image in a recording area of a drum-like photosensitive medium 1 by means of a first developing unit, whereon the photosensitive medium is caused to undergo development process by a second developing unit 22. The color electrophotographic system incorporates therein the image recording apparatus which allows the gap G to be automatically selected in the manner described hereinbefore.

The image recording apparatus includes a power supply unit 11 and a moving actuator 28. The power supply unit 11 serves to apply a voltage, e.g. 10 V between a drum-like photosensitive medium 1 and a developing sleeve 2*a* of a second developing unit 22 during the rotation of the drum 1 and the sleeve 2*a* in the directions indicated by arrows, respectively. The moving actuator 28 includes a reciprocating rod 28*a* which is coupled to the second developing unit 22 so that the second developing unit 22 as a whole can be advanced toward or retracted from the photosensitive drum 1. The actuator may be constituted by a solenoid, cylinder or the like. Thus, the actuator 28 serves to move the developing sleeve 2*a* progressively toward or away from the photosensitive drum 1 in the state when the voltage mentioned above is applied between the photosensitive drum 1 and the developing sleeve 2*a*.

Further, the image recording apparatus further includes a selecting unit for selectively determining an optimal gap G. More specifically, this selecting unit includes a current-to-voltage (C/V) converter 13, an amplifier 29, a reference voltage generator 14, a voltage comparator 15, a counter 30, first and second comparators 31 and 32, a sleeve advancing power supply source 34, as shown in FIG. 8. In operation, when the voltage is applied between the photosensitive drum 1 and the developing sleeve 2*a* during the rotations thereof by the power supply source 11 and when the second developing unit 22 progressively approaches to the photosensitive drum 1 under the action of the moving actuator 28 with the magnetic brush 4*c* on the developing sleeve 2*a* starting to contact with the photosensitive drum surface, a gap current Id begins to increase from a lowest level. A pulse-like current thus produced is processed through the current-to-voltage converter 13 and the amplifier 29 to be compared with a reference voltage generated by the reference voltage comparator 15. The voltage pulses outputted from the comparator 15 are counted by the counter 30. When the counted pulse number is smaller than a predetermined value, the first comparator 31 operates to drive the actuator in the advancing direction by controlling the advancing power supply source 27. As a result of this, the developing sleeve 2*a* approaches to the photosensitive drum 1. On the other hand, when the developing sleeve 2*a* approaches excessively closely to the photosensitive drum 1, the counted pulse number becomes greater than the predetermined value, resulting in that the second comparator 32 operates to drive the actuator 28 in the retracting direction through the medium of the retracting power supply source 34. By driving the actuator 28 on the basis of the pulse number in this manner, the gap G can be selectively set at a desired value.

The image recording apparatus further includes an eccentricity accommodating mechanism which is effective to move the second developing unit in the direction to cancel out or accommodate the eccentricity of the photosensitive drum 1, if it occurs. The eccentricity accommodating mechanism is composed of a rail 33 mounted on the second developing unit 22, a guide rail 37 for guiding the rail 33 along the direction in which the eccentricity of the rotating photosensitive drum 1 takes place, and a database 35 storing data concerning displacements (in the horizontal direction in the case of the illustrated embodiment) of the second developing unit along the directions in which eccentricities of the rotating photosensitive drum occur. When eccentricity occurs in the rotation of the photosensitive drum 1, an electric motor 36 and the guide rail 37 are rotated on the basis of the contents stored in the database 35, as a result of which the second developing unit is displaced as a whole by the rail 33 in the direction to absorb or compensate for the eccentricity. In this way, even when the eccentricity of the photosensitive drum 1 takes place during rotation thereof, the gap G between the photosensitive drum 1 and the developing sleeve 2*a* can always be held constant.

The developer 4 of the second developing unit 22 is composed of a resin carrier 4*a* having a resistance in the range of semiconductor and a nonmagnetic toner 4*b*. In that case, when a carrier of high insulation property is used, the developer 4 naturally exhibits a high electric resistance. In that case, the gap current Id observed for setting the gap between the photosensitive drum and the developing sleeve decreases remarkably, involving necessity for increasing the sensitivity. However, with a high sensitivity, the measurement or observation is likely to be affected by noise, presenting an obstacle to the measurement of the pulse-like current.

Such being the circumstances, the image recording apparatus is further provided with a resistance value adjusting mechanism which serves to lower the electric resistance of the developer 4 to within a range of reference resistance values, when the developer 4 exhibits a higher resistance than a reference resistance value. The resistance value adjusting mechanism includes a container 41 for accommodating electrically conductive magnetic particles, a measuring unit 42 for measuring electric resistance of the developer 4 used in the second developing unit 22, and a charger 43 for supplying and admixing the electrically conductive magnetic particles from the container 41 to the developer 4 of the second developing unit 22. At that time, an output signal of the resistance measuring unit 42 is constantly monitored to thereby stop the addition of the electrically conductive magnetic particles from the container 41 at the time point when the electric resistance of the developer falls within the range of standard resistance value. Parenthetically, the developer of high insulation property has an electric resistance higher than about $10^{11}\ \Omega$ while the reference or standard resistance value lies in a range of $10^{8}$ to $10^{11}\ \Omega$, by way of example.

In the case of the embodiment of the invention described above, the gap G can selectively be set at an optimal value beforehand in an automated manner though cooperation of the power supply source 11, the moving actuator 28 and the selecting mechanism incorporated in the image recording apparatus. Besides, owing to the eccentricity accommodating or absorbing mechanism built in the image recording apparatus, which functions to displace the developing sleeve 2a of the second developing unit 22 so as to absorb or cancel out even a small eccentricity occurring in the rotating photosensitive drum 1, the gap G can constantly be maintained at the selected value. In other words, regardless of the eccentricity of the photosensitive drum, the gap G can be maintained at an optimal position. Further, when the electric resistance value of the developer 4 is higher than the reference or standard resistance value, the resistance adjusting mechanism operates to lower the electric resistance value of the developer 4 to within a standard resistance range, as a result of which the gap G can be established with high reliability without need for increasing the sensitivity of the current measurement. In this conjunction, it is noted that a bias current for image development increases when an electrically conductive magnetic powder is used. However, such increase of the bias current will exert practical no adverse influence to the formation of the magnetic brush 4c on the developing sleeve 2a. Parenthetically, the first illuminating unit 38 serves for the same function as the one shown in FIG. 7.

In the above description directed to the two-color image recording apparatus, the degree of contact of the magnetic brush formed on the developing roller with the photosensitive drum is set at a relatively high level while that of the magnetic brush of the second developing unit is set relatively small. It should however be understood that there is no necessity for increasing the degree of contact of the magnetic brush on the developing roller of the first developing unit. To say in another way, contacting forces of both the magnetic brushes formed in the first and the second developing units may be weakened while ensuring sufficient stability of the recording quality, which in turn means that abrasion fatigue of the photosensitive drum can be reduced sufficiently. It should be added that in a three- or multi-color image recording apparatus, the contacting force of the magnetic brushes formed on the developing rollers in plural developing units can be weakened.

As will now be appreciated from the foregoing description, the gap between the photosensitive medium and the developing roller of the developing unit can properly be selected on the basis of magnitude of a current flowing between the photosensitive medium and the developing roller by applying a voltage thereacross. Thus, even though the gap is of extremely delicate nature, the relation between the gap and the height of the magnetic brush can definitely be established.

Further, since the contacting force of the magnetic brush exerted onto the photosensitive medium can positively be weakened, it is possible to form optimally not only the toner image of a first color but also a succeeding toner image of another color, whereby the image printing or recording can be accomplished with high reliability and accuracy. Moreover, since a relatively low voltage is sufficient for producing an electric current flow between the photosensitive medium and the developing roller, there is no possibility of electric discharge taking place in the gap, which can thus be set with an enhanced adjustability.

What is claimed is:

1. An image recording method of forming a magnetic brush of a two-component developer on each of developing rollers provided in a plurality of developing units, respectively, forming a toner image of a first color on a recording area of photosensitive medium by a first one of said plural developing units and then forming a toner image of another color on the recording area of said photosensitive medium by a succeeding developing unit through contact of said magnetic brush with said photosensitive medium during a single rotation of said photosensitive medium, comprising the steps of:

a) applying a predetermined voltage between said photosensitive medium and a developing roller of at least one of said plural developing units;

b) measuring a current flowing between said photosensitive medium and said developing roller upon application of said predetermined voltage; and c) determining the current flowing between said photosensitive medium and said developing roller in a range from a value representing an initial contact state in which only a tip end portion of said magnetic brush is brought into contact with said photosensitive medium to a value representing a wholly contact state in which said magnetic brush contacts substantially wholly with said photosensitive medium by changing a degree of the contact of said magnetic brush with said photosensitive medium, and selecting a gap between said photosensitive medium and said developing roller within said range.

2. An image recording method according to claim 1, wherein the step of applying the predetermined voltage includes a sub-step of selecting a voltage of such magnitude that no electric discharge can take place between said photosensitive medium and said developing roller, as the predetermined voltage.

3. An image recording method according to claim 1, wherein the step of applying the predetermined voltage includes a sub-step of selecting a voltage in a range of 1 to 250 volts, as the predetermined voltage.

4. An image recording medium according to claim 1, including the further step of selecting said two-component developer used for forming said magnetic brush, said two-component developer containing a toner and a resin binding carrier.

5. An image recording method according to claim 1, including the further step of selecting said two-component developer used for forming said magnetic brush, said two-component developer containing a toner and a resin binding carrier, wherein said resin binding carrier is formed of a semiconductive material.

6. An image recording method according to claim 1, including the further step of selecting said two-component developer used for forming said magnetic brush, said two-component developer containing a magnetic toner and a resin binding carrier, wherein a proportion of said magnetic toner relative to a total amount of said resin binding carrier is over 70%.

7. An image recording method of forming a magnetic brush of a two-component developer on each of developing rollers provided in a plurality of developing units, respectively, forming a toner image of a first color on a recording area of photosensitive medium by a first one of said plural developing units and then forming a toner image of another color on the recording area of said photosensitive medium by a succeeding developing unit through contact of said magnetic brush with said photosensitive medium during a single rotation of said photosensitive medium, comprising the steps of:

a) setting a waveform pattern of a current flowing between said photosensitive medium and a developing roller on the basis of a predetermined degree of contact of said magnetic brush with said photosensitive medium;

b) applying a predetermined voltage between said photosensitive medium and the developing roller of at least one of said plural developing units;

c) measuring a current flowing between said photosensitive medium and said developing roller upon application of said voltage; and d) selecting a gap between said photosensitive medium and said developing roller on the basis of magnitude of said current measured and a current waveform pattern representing degree of contact of said magnetic brush with said photosensitive medium while changing said degree of contact.

8. An image recording method of forming a magnetic brush of a two-component developer on each of developing rollers provided in a plurality of developing units, respectively, forming a toner image of a first color on a recording area of photosensitive medium by a first developing unit and then forming a toner image of another color on the recording area of said photosensitive medium by a succeeding developing unit through contact of said magnetic brush with said photosensitive medium during a single rotation of said photosensitive medium, comprising the steps of:

a) setting a waveform pattern of a current flowing between said photosensitive medium and a developing roller on the basis of a predetermined degree of contact of said magnetic brush with said photosensitive medium;

b) moving the developing roller of said developing unit away from said photosensitive medium to such an extent that said magnetic brush does not contact with said photosensitive medium;

c) applying a predetermined voltage between said photosensitive medium and the developing roller of at least one of said plural developing units; and d) decreasing progressively a gap between said photosensitive medium and said developing roller in the state where said voltage is applied, monitoring magnitude of said current flowing between said photosensitive medium and said developing roller as well as said current waveform pattern, said current and said current waveform pattern changing as said gap decreases, and selecting the gap between said photosensitive medium and said developing roller so that a current waveform pattern as monitored coincides at least approximately with said predetermined waveform pattern.

9. An image recording method of forming a magnetic brush of a two-component developer on each of developing rollers provided in a plurality of developing units, respectively, forming a toner image of a first color on a recording area of photosensitive medium by a first developing unit and then forming a toner image of another color on the recording area of said photosensitive medium by a succeeding developing brush unit through contact of said magnetic brush with said photosensitive medium during a single rotation of said photosensitive medium, comprising the steps of:

a) mounting a metallic drum having an electric resistance of substantially zero as said photosensitive medium;

b) setting a waveform pattern of a current flowing between said metallic drum and a developing roller on the basis of a degree of contact of said magnetic brush with said metallic drum;

c) applying a predetermined voltage between said metallic drum and the developing roller of at least one of said plural developing units;

d) measuring a current flowing between said metallic drum and said developing roller upon application of said voltage;

e) setting a gap between said metallic drum and said developing roller on the basis of magnitude of the current flowing between said metallic drum and said developing roller as well as said current waveform pattern representing the degree of contact of said magnetic brush with said metallic drum; and f) replacing said metallic drum by a semiconductive photosensitive medium after setting of said gap.

10. An image recording apparatus for forming a magnetic brush of a two-component developer on each of developing rollers provided in a plurality of developing units, respectively, forming a toner image of a first color on a recording area of photosensitive medium by a first developing unit and then forming a toner image of another color on the recording area of said photosensitive medium by a succeeding developing unit through contact of said magnetic brush with said photosensitive medium during a single rotation of said photosensitive medium, comprising:

a) said photosensitive medium having a recording area on an outer surface thereof in which a toner image is formed in the course of rotation of said photosensitive medium;

b) a power supply source for applying a predetermined voltage between said photosensitive medium and a developing roller of at least one of said plural developing units;

c) a monitoring unit for measuring a current flowing between said photosensitive medium and said developing roller, converting the measured current into a pulse waveform and comparing said pulse waveform with a predetermined reference pulse waveform;

d) a selecting unit for selectively determining a gap between said photosensitive medium and the developing roller of said at least one developing unit on the basis of result of the comparison available from output of said monitoring unit; and e) a moving unit for advancing or retracting said at least one developing unit toward or from said photosensitive medium on the basis of the gap determined by said selecting unit.

11. An image recording apparatus according to claim 10, wherein said photosensitive medium includes a semiconductive photosensitive medium.

12. An image recording apparatus according to claim 11, wherein said moving unit includes an eccentricity absorbing unit for accommodating eccentricity of said photosensitive medium possibly taking place during rotation thereof.

13. An image recording apparatus according to claim 12, wherein said eccentricity absorbing unit includes a guide rail, a rail moving on and along said guide rail while supporting said developing unit, a motor for driving said rail, and a database storing data concerning positional deviations for commanding said motor to revolve said photosensitive medium in accordance with eccentricity thereof.

14. An image recording apparatus according to claim 11, wherein said monitoring unit includes a resistance decreasing unit for decreasing electric resistance of an insulation layer forming the outer surface of said photosensitive medium.

15. An image recording apparatus according to claim 11, wherein said selecting unit includes a first comparator which operates when the number of the pulses outputted from said counter is smaller than a reference value, an advancing power supply source for commanding said moving unit to move said developing roller toward said photosensitive medium in response to operation of said first comparator; a second comparator which operates when the number of pulses outputted from said counter is greater than a predetermined value, and a retracting power supply source for commanding said moving unit to retract said developing roller from said photosensitive medium in response to operation of said second comparator.

16. An image recording apparatus according to claim 10, wherein said monitoring unit includes a resistance adjusting unit for lowering the electric resistance of the two-component developer contained within said developing unit to within a standard range when said electric resistance is higher than a reference electric resistance value.

17. An image recording apparatus according to claim 16, wherein said resistance adjusting unit includes a container containing electrically conductive magnetic particles, measuring structure for measuring the electric resistance of the two-component developer accommodated within said developing unit, and supply structure for admixing said electrically conductive magnetic particles to the developer accommodated within said developing unit from said container to thereby lower the electric resistance of said developer to within a standard resistance range when the electric resistance of said two-component developer is detected to be higher than the reference resistance value.

18. An image recording apparatus according to claim 10, wherein said monitoring unit includes at least a current-to-voltage converter for converting the current flowing between said photosensitive medium and said developing roller, a reference voltage generator for generating a reference voltage for the voltage generated by said current-to-voltage converter, a voltage comparator for comparing said voltage with said reference voltage, and a counter for counting pulses outputted from said comparator.

* * * * *